United States Patent [19]

Paul et al.

[11] Patent Number: 4,717,794

[45] Date of Patent: Jan. 5, 1988

[54] INTERLOCK SWITCH

[75] Inventors: Donald C. Paul, Downers Grove; Dennis R. Cakora, Manhattan, both of Ill.

[73] Assignee: Tricon Industries, Incorporated, Downers Grove, Ill.

[21] Appl. No.: 891,949

[22] Filed: Aug. 1, 1986

[51] Int. Cl.[4] ..... H01H 9/20

[52] U.S. Cl. ..... 200/50 A; 200/61.62; 219/10.55 C

[58] Field of Search ..... 200/50 A, 61.62, 50 C; 219/10.55 C, 10.55 D

[56] References Cited

U.S. PATENT DOCUMENTS 4,516,007 5/1985 Ringdahl et al. ..... 200/61.62 X 4,528,430 7/1985 Lewandowski et al. ..... 200/61.62

*Primary Examiner*—A. D. Pellinen

*Assistant Examiner*—Morris Ginsburg

*Attorney, Agent, or Firm*—Hill, Van Santen, Steadman & Simpson

[57] ABSTRACT

A switch mechanism for controlling circuits such as in a microwave oven including a housing with a removable cover and a latch member and plunger member movable between a first position wherein the microwave oven door is closed and a second position, with the primary microwave circuits closed in said first position. Contact arms which all extend in one direction toward the latch member and plunger, a catch for holding the door closed, a slide for operating the primary switch means, and a cam operated by the plunger for operating switch means, all are slidably removable from the housing in a lateral direction. The switch sequence is arranged so that one set of primary contacts open after the other, and the structure is arranged so that if the slide for operating the switch means sticks, the movement of the plunger to the second position will insure that the circuit containing the primary switch means is opened.

8 Claims, 10 Drawing Figures

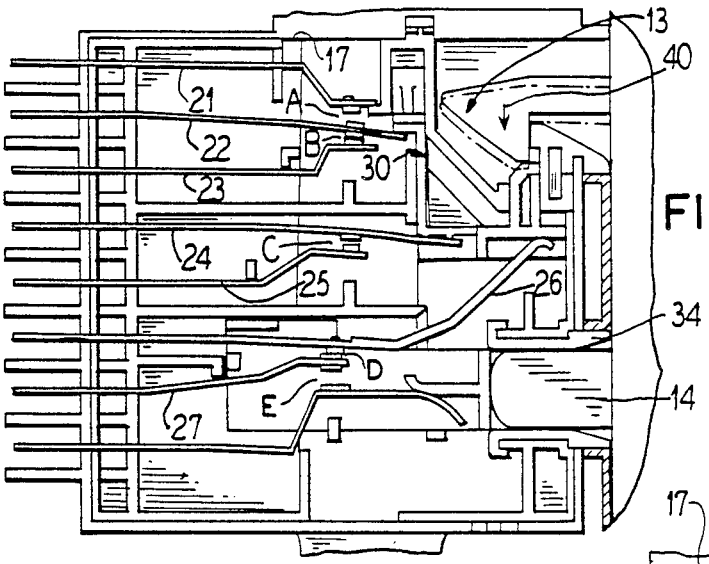
FIG. 7
FIG. 8
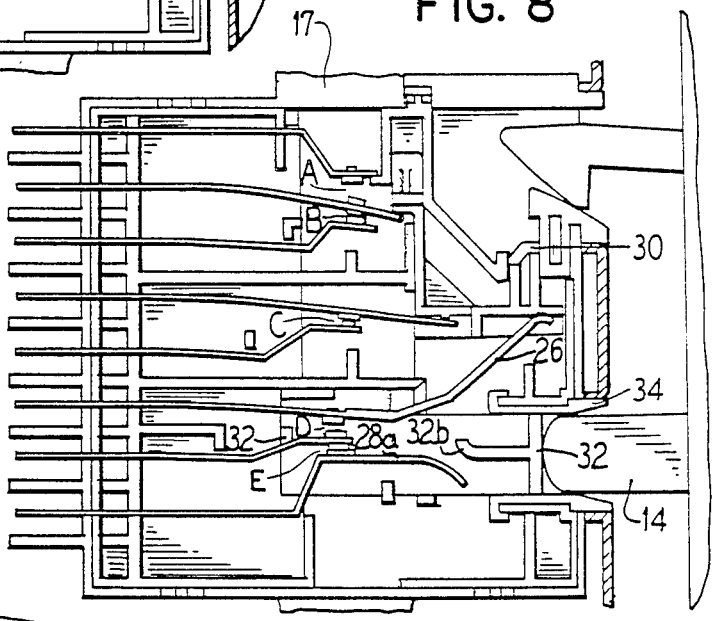
FIG. 10
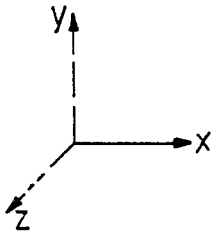
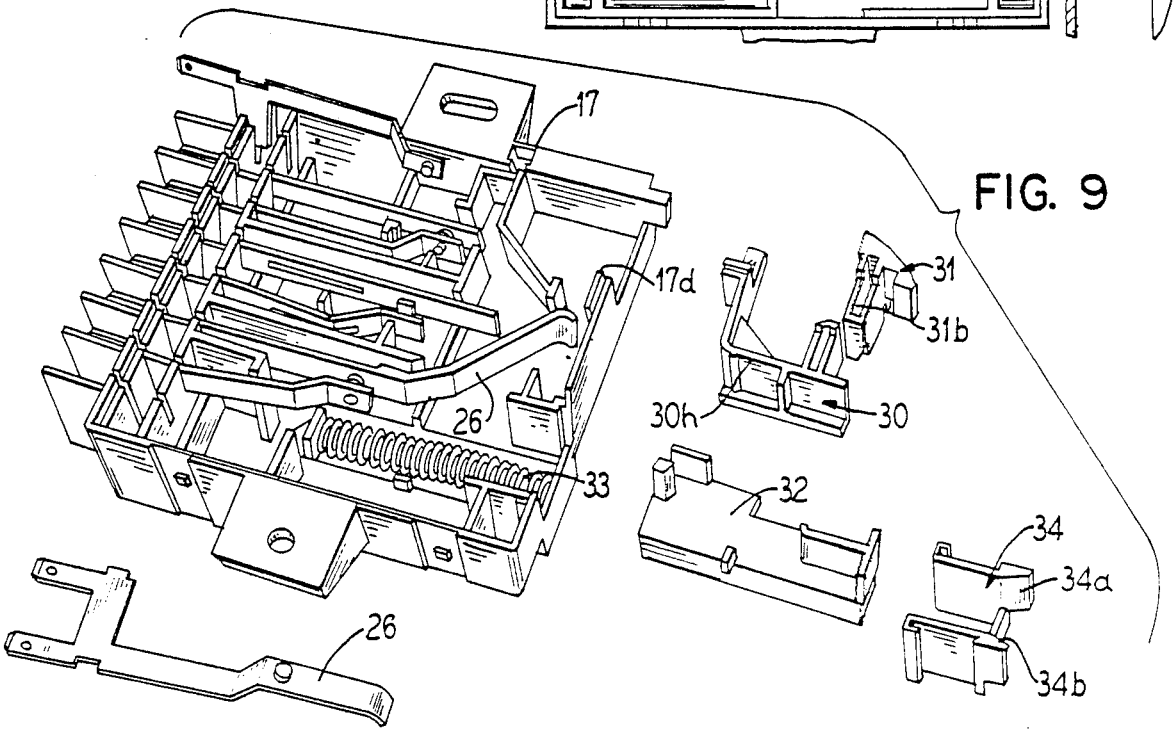
FIG. 9

INTERLOCK SWITCH

BACKGROUND OF THE INVENTION

The present invention relates to improvements in switching mechanisms and particularly to a mechanism suited for controlling the circuits of a microwave oven.

In microwave ovens, existing standards established by practice, for optimum operation, and for safety reasons, require the precise and reliable control of a number of circuits. One of these circuits is the primary microwave circuit which normally is operated by separate switches which for safety reasons are connected in series so that both switches must be closed before the microprocessor will operate. Other switches which are employed are a light switch, a microprocessor timer switch and a monitor switch.

Convention and safety require that these switches must be sequenced in a controlled order in one direction when the door of the microwave oven is closed and in the opposite order when the door of the microwave oven is opened. When the door is open, the light switch is closed, the microprocessor timer switch is open, the monitor switch is closed and, of course, the primary microwave switches are open. When the door is closed, the light switch is opened, the two primary microwave switches are closed, the microwave timer switch is closed, and the monitor switch is opened. A control mechanism for these switches must be able to accomplish the foregoing switching operation, and additionally has other requirements for reliability and safety.

Of principal importance is the reliability and safety of the device and the switch operating mechanism must be capable of operating hundreds of thousands of repeated times without failure and be capable of being operated reliably so that with each opening and closing of the door, all switches are properly operated.

The durability, simplicity and reliability of the mechanical operating structure is essential both from the standpoint of safety and from the standpoint of reliability and avoidance of cost replacement. For this reason a structure is necessary which has parts having minimum travel, with such travel arranged to be most effective for the time when parts are in contact, and the parts simply and durably constructed. Ease of assembly is also important from the standpoint of avoiding any possibility of misassembly and from the standpoint of cost of the structure.

It is accordingly an object of the invention to provide an improved switching arrangement and switch operating mechanism which meets the above stated objectives and avoids difficulties encountered in structures heretofore available.

A further object of the invention is to provide an improved and simplified switch operating mechanism suitable for use in a microwave processing oven which is relatively inexpensive to construct yet is very reliable in operation.

A further object of the invention is to provide an improved reliable switching mechanism which is capable of operating in various environments but is particularly well suited for use in controlling the circuits of a microwave oven.

In accordance with the principles of the invention, a feature is the simplified arrangement of the switch leaves and the operating mechanism therefor. A case or housing is provided with one front wall removable and all elements including switch leaves, slides, cams and latches are insertable from one direction with all of the switch leaves projecting in one direction so as to be supported on one double end wall of the case. Further, control for switching purposes and safety arrangements is achieved through a latch and plunger which operate a slide and a cam both of which are slidably removable from the case for replacement. Also, the latch is provided with a hook to be held by a catch which is also slidably replaceable.

Other advantages, objectives and features will become more apparent with the teaching of the principles of the invention in connection with the disclosure of the preferred embodiments thereof in the specification, claims and drawings, in which:

DESCRIPTION OF THE DRAWINGS

FIG. 7 is a plan view similar to FIG. 2 and illustrating the sequential switch closing of the primary microprocessor switches as the door is being closed;

FIG. 8 is a view similar to FIGS. 2 and 4 and illustrating a safety feature of the invention wherein the primary microwave circuit is maintained open if the structure malfunctions by a slide sticking;

FIG. 9 is an exploded view illustrating the relationship between parts as they are removed; and FIG. 10 is a schematic view illustrating the X, Y and Z axis referred to in the description.

DESCRIPTION OF THE PREFERRED EMBODIMENTS

Figure 1:
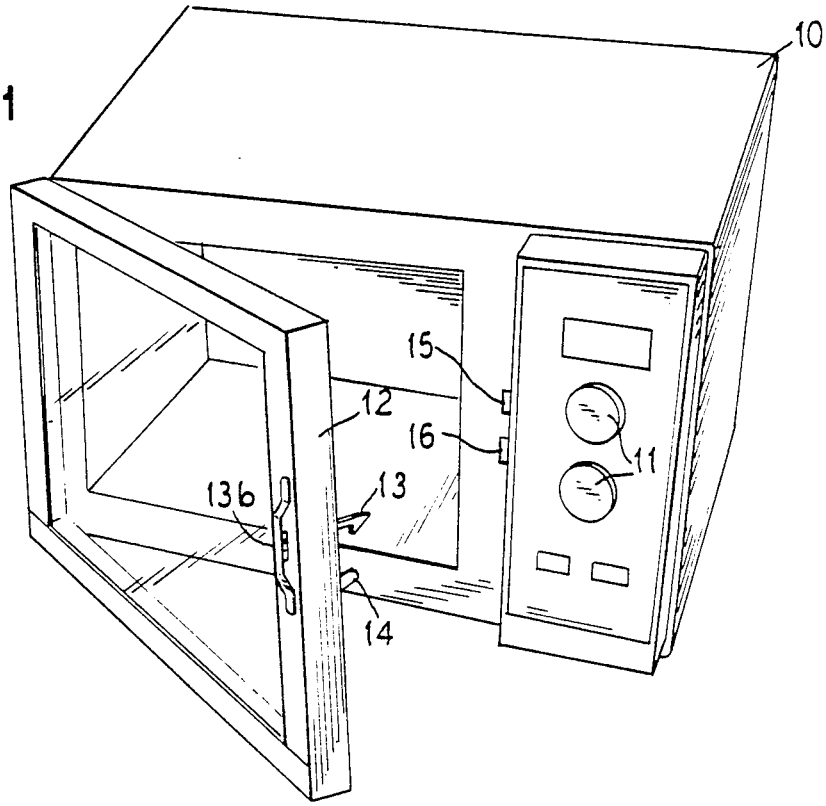
FIG. 1 is a perspective view of a microwave oven which is illustrated as a type of mechanism in which the switch of the invention has particular utility.

FIG. 1 illustrates a microwave oven 10 which is the type of appliance in which the switch of the present invention may be employed. In the microwave oven, control knobs are shown at 11 and the oven has a door 12 which is hinged on the cabinet so as to swing between an open position, as shown, and a closed position. As the door moves to the closed position, a latch 13 and a plunger 14 enter openings 15 and 16 respectively in the oven. Behind these openings is positioned a control switch mechanism which is shown in the detailed drawings of FIGS. 2 through 9. The latch 13 is pivotally mounted and operated by the operator working a hand gripper or similar device as illustrated at 13*b* to pivot the latch for releasing it when the door is to be opened. When the door is pushed shut, the latch will engage a catch to hold the door shut. When the operator pushes on the release 13*b*, the latch 13 pivots upwardly to release the door to open. The open position, as shown in FIG. 1, will be referred to as the second position and the closed position as the latch 13 and plunger 14 enter the openings will be referred to as the first position.

Figure 4:
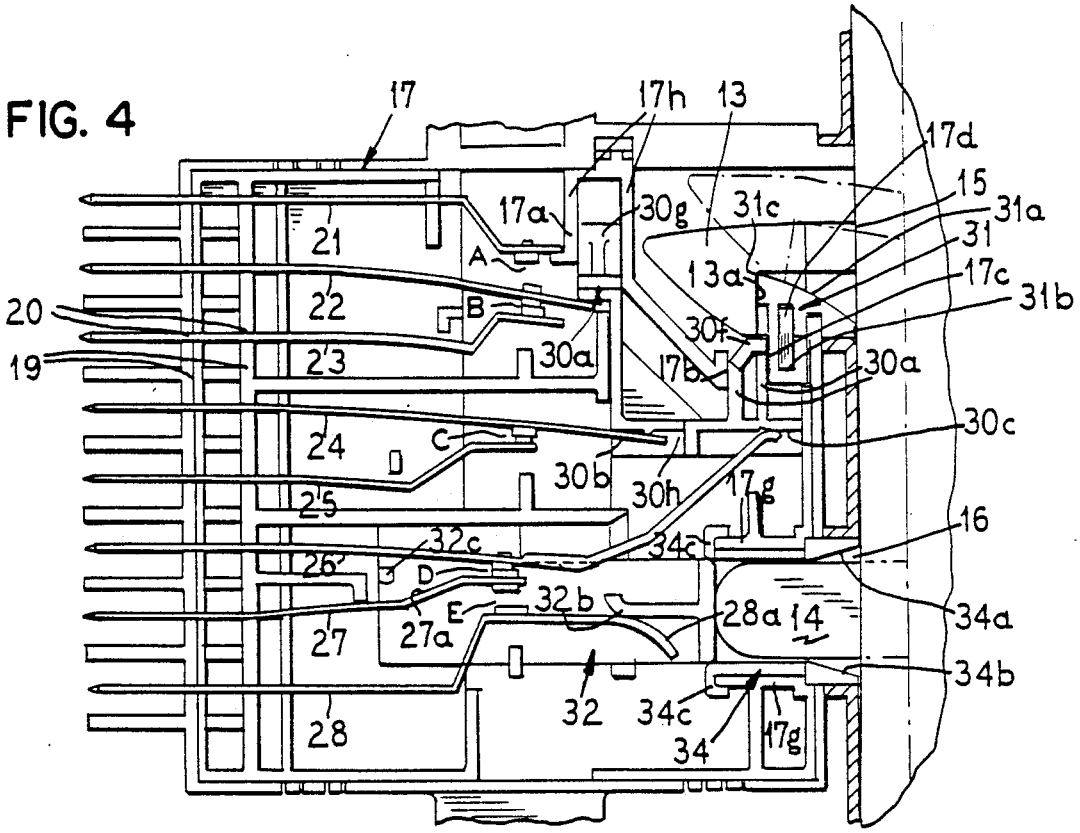
FIG. 4 is an elevational view similar to FIG. 3 but illustrating the parts as they would appear with the door in closed position and the primary microwave switches closed.

FIG. 4 shows the switch mechanism in detail. The latch and the plunger are shown in the first or closed position in FIG. 4. As the door moves to the closed position, the latch 13 rides over a catch 31 by being cammed up on the inclined surface 31*a* of the catch (as indicated by the broken line position of the latch) and then snaps down to a locked position, as shown by the solid line position. In the locked position, the hook 13*a* locks behind a catch surface 31*c* to lock the door in closed position. When the door is to be opened, the latch 13 is pivoted up to the broken line position so that it can pass over the top of the catch 31.

The switch operating mechanism and the switches are contained in a plastic case or housing 17 which is secured to the microwave oven wall.. The case 17 has a removable cover 18 which closes the face on one side of the case. For purposes of explaining the movement of the parts in the various directions, reference will be made to the X, Y and Z direction as generally illustrated by the schematic sketch shown in FIG. 10. As the door moves from open to closed position, it is moving in the X direction. As the latch snaps from the dotted-line open position to the closed position, (FIG. 4) it is moving vertically in the Y direction. The observer is facing the switch mechanism in the Z direction in FIGS. 2, 4, 7 and 8.

Figure 2:
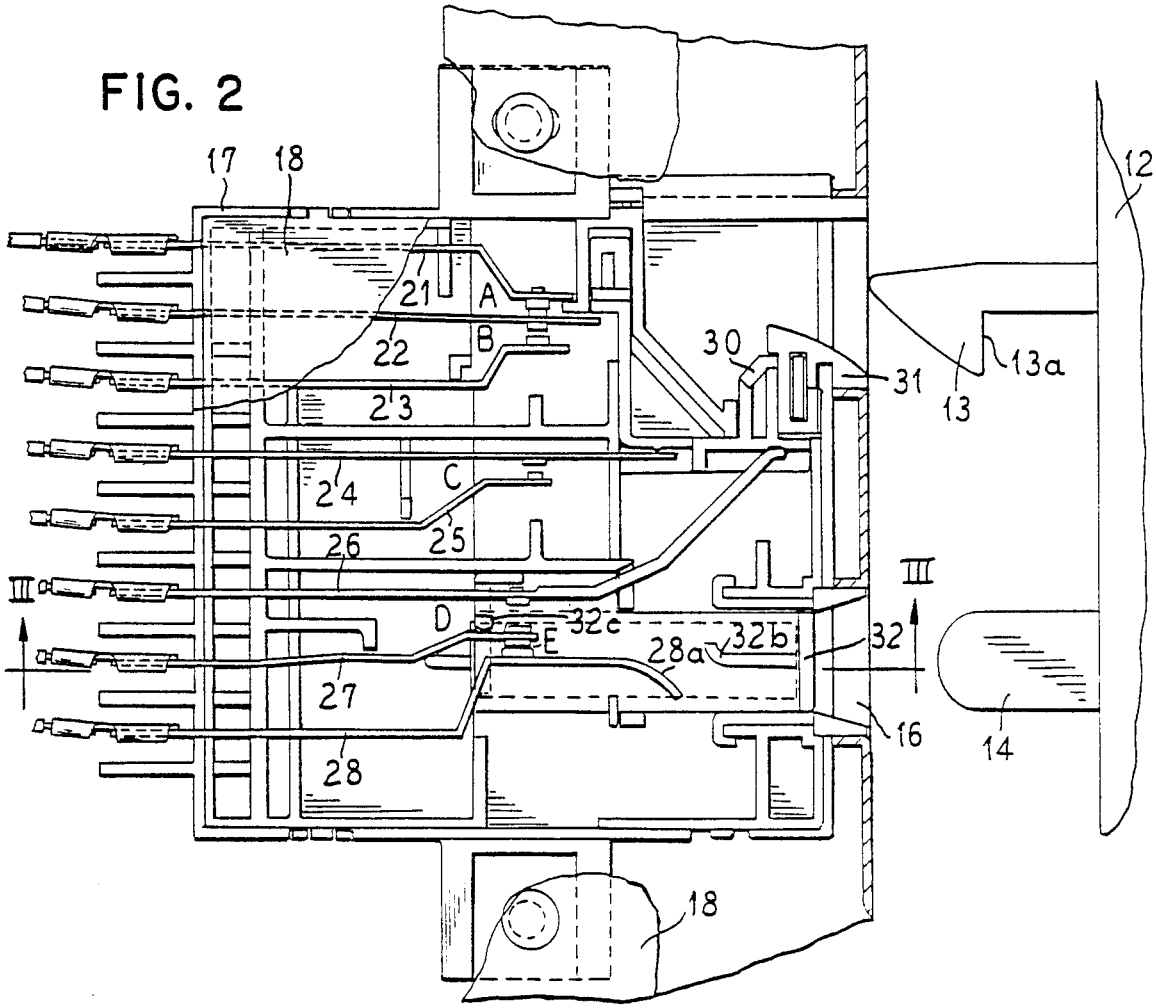
FIG. 2 is an elevational view of a switch embodying the principles of the present invention with the cover plate partly broken away to illustrate the interior.

The switch case 17 supports resilient switch arms within the case with the arms being shown at 21, 22, 23, 24, 25, 26, 27 and 28. The structures referred to as switch arms carry contacts and may more appropriately be called contact arms, but for convenience are principally referred to as switch arms. These switch arms conveniently all extend in the same direction, that is they extend in the X direction but toward the second or opened position of the door. In addition to extending in the same direction, all switch arms are inserted or removed in the housing in slots which open in the Z direction until their tabs on the bottom fit between the double wall. For this purpose, the case 17 has a double wall 19 which has slots 20 cut therein with each of the slots accommodating a switch arm. The switch arms for assembly are slipped into each of the slots being pushed downwardly in the Z direction. The switch arms have biases which hold them in various positions for making and breaking the contacts. The actual switches are shown at locations A, B, C, D and E. The switches are constructed so that leads are attached thereto as shown in FIG. 2.

Figure 5:
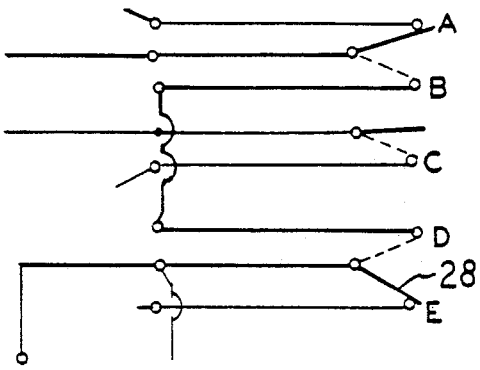
FIG. 5 is a schematic view illustrating the electrical connections for the switches.

FIG. 5 is a typical switch schematic for a microwave oven generally connected to 110 V household current, however the said switch is capable of 20.1 AMP, 250 VAC at 60 Hz or 16.0 AMP, 250 VAC at 50 Hz.

Switches B and D are the primary microwave circuit switches and are interconnected in series so that both must be closed for the microwave to operate. Switch C is a microprocessor timer and is connected so that it must be closed for the microprocessor to operate. Switch C will have a timer in series with it and the timer may be manual or electrically operated in a manner so that the circuit will open to stop the microprocessor as a predetermined amount of time elapses. Switch E is a monitor switch which functions as a safety fail-safe circuit and insures nonoperation of the microprocessor when the door is opened.

An additional 9th contact assembly may be added to said switching mechanism to perform an additional function if so required. Deletions and changes in the actual contacts may also be made allowing for a full range of current carrying capabilities from 0.1 AMP. 32 VAC to 20.1 AMP 250 VAC, 60 Hz.

The various circuits and switches are known and exist in a microwave oven but a suitable safe reliable switching operator must be provided to operate the circuitry.

Figure 6:
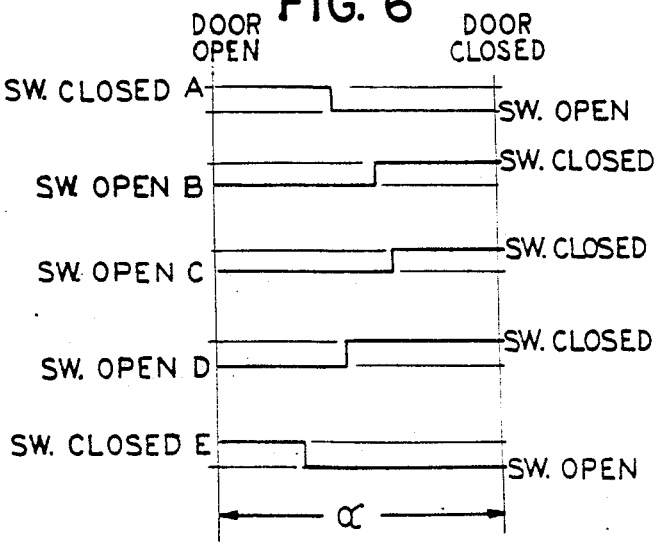
FIG. 6 is a diagrammatic view illustrating the relationship of the position of the switches relative to time and relative to the position of the door.

FIG. 6 illustrates schematically, as a function of time, the relative position or function of the switches as the door moves from an open to a closed position. As will be seen, in the door open position, switches A and E are closed, this also being shown in FIG. 5. As the door is moved to a closed position, switches A and E are opened, and switches B, C and D are closed. A feature of the circuitry which must be satisfied to avoid undesirable electrical effects such as contact bounce is that the primary microwave switches B and D must not open and close at the same time. They are, therefore, arranged so that one switch which will open first when the door is opened, will close last when the door is closed.

The latch, in addition to releasably holding the door shut, functions to operate the upper four switches A, B, C and D.

The upper switch arm 21 is biased in a downward direction so that the outer end of its arm rests on a ledge 17*a* which is part of the case. This permits the switch contacts of the arms 21 and 22 (switch A) to be in engagement when the door is open and the latch 13 is in the second or open position. This situation is shown in FIG. 2. Switch arm 22 is biased so that it moves its free end upwardly to hold the contacts of arms 21 and 22 in engagement and thereby close switch A.

When the latch moves to the first or locked position of FIG. 4, its hook end 13*a* engages and pushes downwardly on a slide 30. Slide 30 has an extension 30*a* which engages the end of the switch arm 22 to pull it downwardly thereby opening switch A when the slide is moved downwardly. The spring bias of the latch 13, will push downwardly on the slide to cause it to operate its switches. For this purpose, the hook portion of the latch engages the upper portion 30*f* of the slide pushing it downwardly. The slide has a vertical double walled portion 30*a* which is slidably carried between the vertical walls 17*b* and 17*c* of the switch case. The slide also has an upper portion 30*g* which slides between walls 17*h* of the case.

The shoulder 30*a* of the slide, pushing the arm 22 downwardly, breaks the switch A and engages the contacts of switch B by the contact.of the arm 22 moving down against the contact of the arm 23. In each instance the contacts of the switch arms are arranged so that as they make or break, they will slide against each other in a slight lateral movement in the X direction thereby creating a wiping of the contact faces helping keep them clean and extending their operating life.

The movement of the slide in a downward direction also carries the switch arm 24 downwardly with the outer end of the switch arm pushed downwardly by a shoulder 30*b* of the slide, the outer end being held in the slot 30*h* of the slide. This closes the switch C bringing the contact of switch arm 24 down against the contact of the switch arm 25.

The downward movement of the slide 30 also causes the face 30*c* of the slide to push downwardly on the switch arm 26. The contact of the switch arm 26 moves against the contact of the switch arm 27 thereby closing the switch D. As will be noted, the switch D can only close if the arm 27 is in the position shown in FIG. 4. When the switch arm 27 is pulled away, that is downwardly from the switch arm 26 as will occur in the position of FIG. 2 when the door is in the opened position, the switch D cannot close.

Turning now to the operation of the plunger 14, as it moves inwardly from the position of FIG. 2 to the position of FIG. 4, that is, from the second to the first position, the plunger 14 engages a plunger cam 32. This plunger cam is slidable and performs switch operating camming operations.

A first cam 32*c* on the plunger cam 32 will move away from the switch arm 27 when the plunger cam is pushed inwardly to the position of FIG. 4. This allows the spring biased switch arm 27 to move upwardly so that the switch D can close when the switch arm 26 is pushed downwardly. The bias of the arm 27 causes it to move upwardly to open the switch E due to the cam 32*c* moving away from the sloping portion 27*a* of the switch arm 27.

A second camming function occurs by operation of the cam 32 with a cam finger 32*b* engaging an end 28*a* of the switch arm 28. This pushes the switch arm 28 downwardly to open the switch E.

Figure 3:
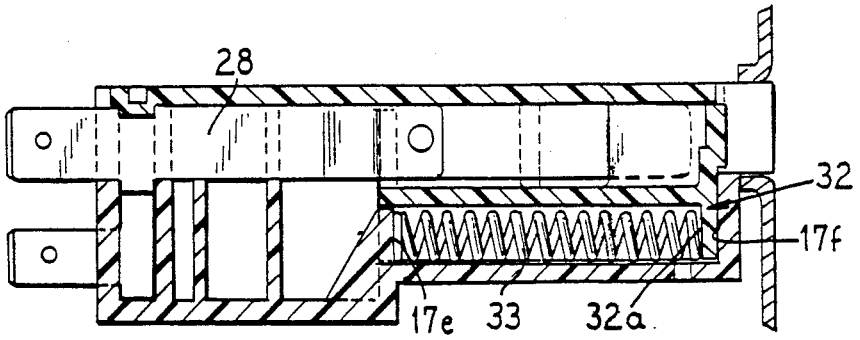
FIG. 3 is a sectional view taken substantially along line III—III of FIG. 2.

The cam 32 is slidably mounted in the switch case as shown in FIG. 3. The cam 32 has a hollow base to house a coil compression spring 33 which is supported against a face 17*e* of the case and pushes against a wall 32*a* of the cam urging the cam in a X direction to the second position. The movement of the cam is limited by it engaging a wall 17*f* of the case.

An important feature of the switch structure is the possibility of assembly and removal of the critical parts. This accommodates replacement with wear but also guards against breakage of the parts and helps enable long wear. Each of the parts, the catch 31, the slide 30, the cam 32 and the guide 34 are removable from the case in the Z direction, that is, toward the viewer in FIGS. 2, 4, 7, 8 and 9. With respect to the catch, it has a rectangular hollow portion 31*b*, FIGS. 4 and 9, which holds it over a rectangular boss 17*d* of the case. When the catch is to be removed, it is merely pulled outwardly in the Z direction out of the case. Of course, the cover 18 is first removed to expose all of the parts whereupon the aforementioned parts and the switch arms can all be withdrawn in the same Z direction.

The slide 30 is similarly easily removable. It is held in its place by the bias of the switch arms 22,, 24 and 26 and is slidable between the surfaces 17*h* of the housing and 17*b* and 17*c* also of the housing.

The plunger cam 32 also slides readily out of the case in the Z direction. To provide a wear and guide surface, a U-shaped insert 34 is positioned in the case as a guide for the plunger and for the plunger cam. These inserts of a different material provide a surface which virtually eliminates wear. The U-shaped guide is held in the opening 16 in the switch case and has wrap-around ends 34*c* which clinch themselves against wall portions 17*g* of the case. The U-shaped guide also has ramp areas 34*a* and 34*b* to receive the plunger 14 when the door is moved to closed position and when the plunger/engages and pushes the cam 32.

In operation, the microwave oven door moves from an open position as shown in FIG. 1 wherein the parts approach the openings 15 and 16 as shown in FIG. 2 to move from an open position to a closed position of the latch 13 and the plunger 14. When the latch, moves to the closed position of FIG. 4, it snaps over the catch 31 and its hook tip pushes downwardly on the slide 30. The slide closes the contacts of switches B, C and D. The switch arms 22 and 26 are so arranged so that the two switches B and C do not close simultaneously but close sequentially with the switch D closing first as illustrated in the showing of FIG. 6.

At the same time, the plunger 14 pushes in the cam 32 so that the first cam surface 32*c* releases the arm 27 so that switch D can close. The cam finger 32*b* pushes downwardly on the arm 28 to open the monitor switch E and this is the first switch that opens as will be seen by the diagram of FIG. 6.

The sequential closings of switches D and B occurs as illustrated in FIG. 7 with the latch moving downwardly as indicated by the arrowed line 40 and the slide also moving downwardly. Switch D first closes and switch B is just approaching the closed position. Further travel of the slide from the position of FIG. 7 to the position of FIG. 4 will complete the closing of switch B.

Another feature of the invention is a safety factor afforded by the structural arrangement. In the unlikely event that the slide 30 would stick down when the door is opened, the circuit to the microprocessor would be broken so that the operator cannot be injured. This is insured by the plunger 14 moving outwardly and the plunger cam 32 moving with its first cam surface 32*c* against the switch arm 27 to break the contacts at D. Since the contact D is in series circuit with the contact B, the opening of D will break the circuit despite the fact that B may remain closed due to the sticking of the slide 30. This is illustrated in FIG. 8 where the slide is shown as artificially sticking downwardly and yet the moving of the plunger 14 outwardly with its cam 32 moving outwardly will insure the opening of the switch D.

FIG. 9 shows the switch- with parts partially removed. That is, the structure of the cam 32 is shown in detail and its structure is illustrated in FIGS. 3 and 9. The cam is removable by sliding out of the assembly in the Z direction. For its operation a spring 33 is held in a concavity of the cam based at one end against a wall 17*e* in the case and pushing on the other end against a wall 32*a* of the cam. A guide insert 34 slides in the X direction into the case for guiding both sides of the cam and this guide provides ramps 34*a* and 34*b* for guiding the plunger 14 into place, FIG. 4.

The case is provided with slots which open in the Z direction and each of the switch blades are readily slidable into the slots to be held frictionally therein. A structure of switch arm 26 is shown in detail at the lower portion of FIG. 9 and as will be observed, for removal from the case, it is drawn out in the Z direction and replacement or reinsertion is accomplished in the same way and by reinsertion into the slots. The same arrangement is provided with the other switch arms.

The slide 30 is similarly inserted or removed from the case in the Z direction and as will be observed from the figures of the drawings, namely 2, 4, 7, 8 and 9, the slide 30 drops into place being held there by surfaces against which it slides, for example 17*b* and 17*c*.

The catch 31 is similarly held in the case by insertion and by being dropped over a boss 17*d* which fits into the hollow 31*b* in the catch.

The plunger 14 is rigidly supported on the door 12 whereas the latch 13 is pivotally mounted and is spring biased in a downward direction as indicated generally by the arrowed line 40 in FIG. 7.

Thus, it will be seen that we have provided an improved switching mechahism which meets the objectives and advantages above set forth and which provides unique features of safety and simplicity.

We claim as our invention:

1. A switch mechanism for controlling circuits such as in a microwave oven, comprising in combination:

a door operated latch member movable between a first position wherein a door is closed so that circuits are actuated and a second position wherein the door is open so that said circuits are reversed;

a door operated plunger member movable with said latch member between said first and second positions;

primary microwave circuit switch means for being connected into a series circuit with said switch means closed in the first position of said latch member and said plunger member;

said switch means open in said second position of said latch and plunger members;

a catch engaging said latch member releasably holding it in said first position;

said plunger member being free to move away from said first position to said second position;

a housing supporting said switch means and said catch;

support means in said housing slidably receiving said catch with said catch being removable in a direction lateral of the movement of said latch member between said first and second positions;

a plunger member operated cam engageable by the plunger member in said first position; and guide means for said plunger cam supporting the cam for slide movement in the same direction as the movement of the plunger member;

said guide means being slidably received by said housing and laterally removable in the direction of movement of the catch when the catch is removed.

2. A switch mechanism for controlling circuits such as in a microwave oven constructed in accordance with claim 1:

including a slide engageable by the latch member;

each of said catch, slide, and plunger cam being removably supported in said housing and slidable laterally of the direction of movement of the latch member from an operative position to a removed position; and a removable housing cover member retaining said slide, catch and plunger cam in their operative positions.

3. A switch mechanism for controlling circuits such as in a microwave oven, comprising in combination:

a door operated latch member movable between a first position wherein a door is closed so that circuits are actuated and a second position wherein the door is open so that said circuits are reversed;

a door operated plunger member movable with said latch member between said first and second positions;

first and second primary circuit contacts for connection in a series circuit with each of said contacts closed in the first position of said latch and said plunger member and each of said contacts open in said second position of said latch and plunger members;

a housing for said contacts;

a plurality of contact arms mounted in said housing at their base with their free ends all projecting toward said second position so that said plunger and latch members move toward the contact arms in said first position; and a plunger cam biased toward said second position and operatively engaged by said plunger member;

said plunger cam being slidably supported for movement in the same direction as the plunger member;

said plunger cam having a first operator engaging a contact arm and holding said second primary contacts open in the second position of said plunger cam.

4. A switch mechanism for controlling circuits such as in a microwave oven constructed in accordance with claim 3:

said first operator releasing a contact arm to permit closure of said second circuits contacts and movement of the plunger from said second to said first position.

5. A switch mechanism for controlling circuits such as in a microwave oven constructed in accordance with claim 4:

said plunger cam including a second operator engaging a further contact arm in movement between said second and first position breaking a monitor circuit, said monitor circuit being closed in the second position of the plunger.

6. A switch mechanism for controlling circuits such as in a microwave oven, comprising in combination:

a latch member for a door movable between a first position wherein the door is closed so that circuits are actuated and a second position wherein the door is open so that said circuits are reversed;

a door connected plunger member movable with said latch member between said first and second positions;

first and second primary microwave circuit switch means having contacts connected for being in a series circuit with each of said switch means having contacts closed in the first position of said latch member and said plunger member and each of said switch means open in said second position;

resilient contact arms each projecting toward said second position;

a slide intermediate the latch member and said contact arms positioned to operate arms for said first and second switch means;

a catch positioned for releasably securing said latch member in said first position;

a cam engageable by the plunger member and movable to operate switch arms for closing and opening said second switch means;

said cam mounted for sliding movement in the same direction as the plunger member;

a housing supporting the contact arms; and means in said housing removably supporting each of said slide, catch and cam for replacement.

7. A switch mechanism for controlling circuits such as in a microwave oven constructed in accordance with claim 6:

wherein said means in the housing accommodates sliding movement of the slide member, catch and cam for removal.

8. A switch mechanism for controlling circuits such as in a microwave oven constructed in accordance with claim 6:

wherein said contact arms carry contacts for first and second primary circuits for a monitor circuit, for a timer circuit, and for a light circuit.

* * * * *